United States Patent [19]

Taylor

[11] Patent Number: 5,007,263

[45] Date of Patent: Apr. 16, 1991

[54] SECURITY DEVICE

[76] Inventor: Bryan V. Taylor, #601 - 7275 Salisbury Avenue, Burnaby, Canada, V5E 4E1

[21] Appl. No.: 542,085

[22] Filed: Jun. 22, 1990

[51] Int. Cl.[5] ..... E05B 13/04

[52] U.S. Cl. ..... 70/416; 70/430; 292/288

[58] Field of Search ..... 70/207, 209, 416, 429, 70/430; 292/288, DIG. 2, 347, 258, 339

[56] References Cited

U.S. PATENT DOCUMENTS

| | | | |
|---|---|---|---|
| 674,776 | 5/1901 | Kraemer | 70/430 |
| 679,758 | 8/1901 | Lang | 70/430 |
| 850,446 | 4/1907 | Robbins | 70/423 |
| 2,463,195 | 3/1949 | Mungan | 70/416 |
| 3,585,827 | 6/1971 | Dominguez | 70/416 |
| 3,933,014 | 1/1976 | Moses | 70/416 |
| 4,827,745 | 5/1989 | Baugh | 70/416 |
| 4,869,086 | 9/1989 | Richards | 70/416 |

*Primary Examiner*—Gary L. Smith
*Assistant Examiner*—Darnell M. Boucher
*Attorney, Agent, or Firm*—H. Jay Spiegel

[57] ABSTRACT

The present invention relates to an improved security device. The improved security device includes a U-shaped member which is designed to engage the shaft of a doorknob. Attached to the U-shaped member is a locking plate which has openings therein to receive either the latch of a deadbolt or the key head of a key inserted into a deadbolt. The improved security device, when in place, prevents entry into a dwelling by a person unlocking a deadbolt by preventing the rotation of a deadbolt latch or a key head inserted into the deadbolt.

4 Claims, 2 Drawing Sheets

SECURITY DEVICE

BACKGROUND OF THE INVENTION

The present invention relates to an improved security device. The improved security device is designed to be used with a deadbolt, either single or double key types, to prevent entry into a dwelling or other similar structure. In the prior art, devices designed to prevent entry are known. The following prior art is known to Applicant:

U.S. Pat. No. 4,673,202 to Willis discloses a door locking device for securing a door having a single key deadbolt. The door locking device is designed to engage the deadbolt latch in the locked position to prevent rotation thereof from the locked position to the unlocked position. The door locking device of Willis is different from that of the present invention in that Willis does not include all of the features of the improved security device including means to secure the locking portion of the security device to an adjacent doorknob.

U.S. Pat. No. 4,746,152 to Willcox discloses a locking device which includes means to permanently attach the device to a door. The locking device of Willcox is different from that of the present invention in that Willcox does not disclose a device which is designed to secure either the latch of a single key deadbolt or a key head in a double key deadbolt as does the improved security device of the present invention.

SUMMARY OF THE INVENTION

The present invention relates to an improved security device. The present invention includes the following interrelated aspects and features:

(A) In a first aspect, the present invention includes a device which is designed to prevent entry into a dwelling or the like by restricting the movement of a latch in a single keyed deadbolt or a key head, while in a double keyed deadbolt. The improved security device includes a U-shaped member which is designed to slide over the shaft of a doorknob.

(B) A locking plate is provided which is designed at a portion thereof to attach to the curved portion of the U-shaped member. The locking plate also includes openings therein which are designed to secure a deadbolt latch or a key head located in a deadbolt in the locked position to prevent entry into a dwelling or the like.

(C) The locking plate includes a first rectangular opening which is designed to receive a latch from a deadbolt and prevent rotation thereof from the locked position to the unlocked position. The locking plate also includes a second opening, configured as a slot, which is adapted to receive a key head while the key is inserted into a double keyed deadbolt.

(D) Means are provided to pivotally attach the locking plate to the curved portion of the U shaped member. The pivotal attachment of the locking plate to the U-shaped member maintains the locking plate in place during use.

(E) In use, the U-shaped member is slid over the shaft of a doorknob with the locking plate being pivotally attached to the curved portion of the U shaped member. The deadbolt is then locked by operation of a latch if single keyed or the turning of a key if double keyed. The locking plate, in the case of a single keyed deadbolt may be slid over the latch in the locked position thereby preventing rotation thereof and unlocking the door.

Alternatively, if a double keyed deadbolt is used, the locking plate may be slid over the exposed key head in the deadbolt cylinder, thereby preventing rotation of the key and unlocking of the door.

Accordingly, it is a first object of the present invention to provide an improved security device.

It is a further object of the present invention to provide a security device which includes means to prevent the unlocking of a deadbolt by restraining the rotation of a latch or key head therein.

It is a yet further object of the present invention to provide an improved security device which includes adjustable features to permit utilizing the device in various configurations of doorknobs and associated deadbolts.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
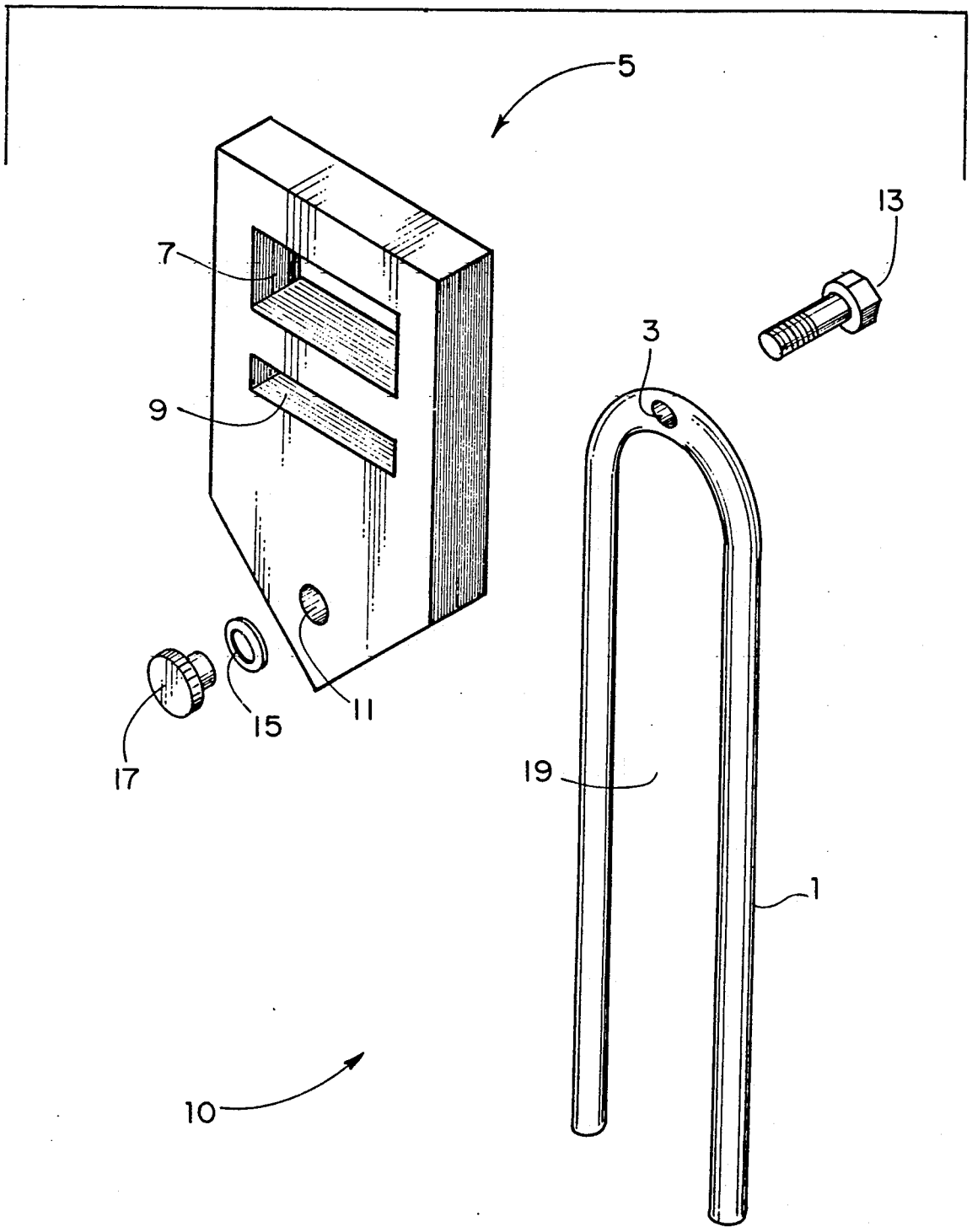
FIG. 1 shows a perspective view of the improved security device, exploded to show greater detail.

With reference to FIG. 1 firstly, the present invention is generally designated by the reference numeral 10 and is seen to include a U-shaped member 1 having an opening 3 therein and a locking plate 5, the locking plate 5 having a rectangular opening 7 in an upper region, a slot 9 in a middle region and a circular opening 11 therein in a lower region. The U-shaped member 1 is designed to be pivotally connected to the locking plate 5 by the bolt 13 and washer and nut, 15 and 17, respectively. The bolt 13 is designed to slide through the aligned openings 3 and 11 and be fastened by the knurled nut 17.

The U-shaped member 1 forms an opening 19 which is designed to receive the shaft of an interior doorknob when the improved security device is in use. The rectangular opening 7 in the locking plate 5 is designed to receive the latch of a deadbolt when in the locked position. The slot 9 of the locking plate 5 is designed, in an alternative mode, to receive a key head inserted in a double keyed deadbolt while in the locked position.

Figure 2:
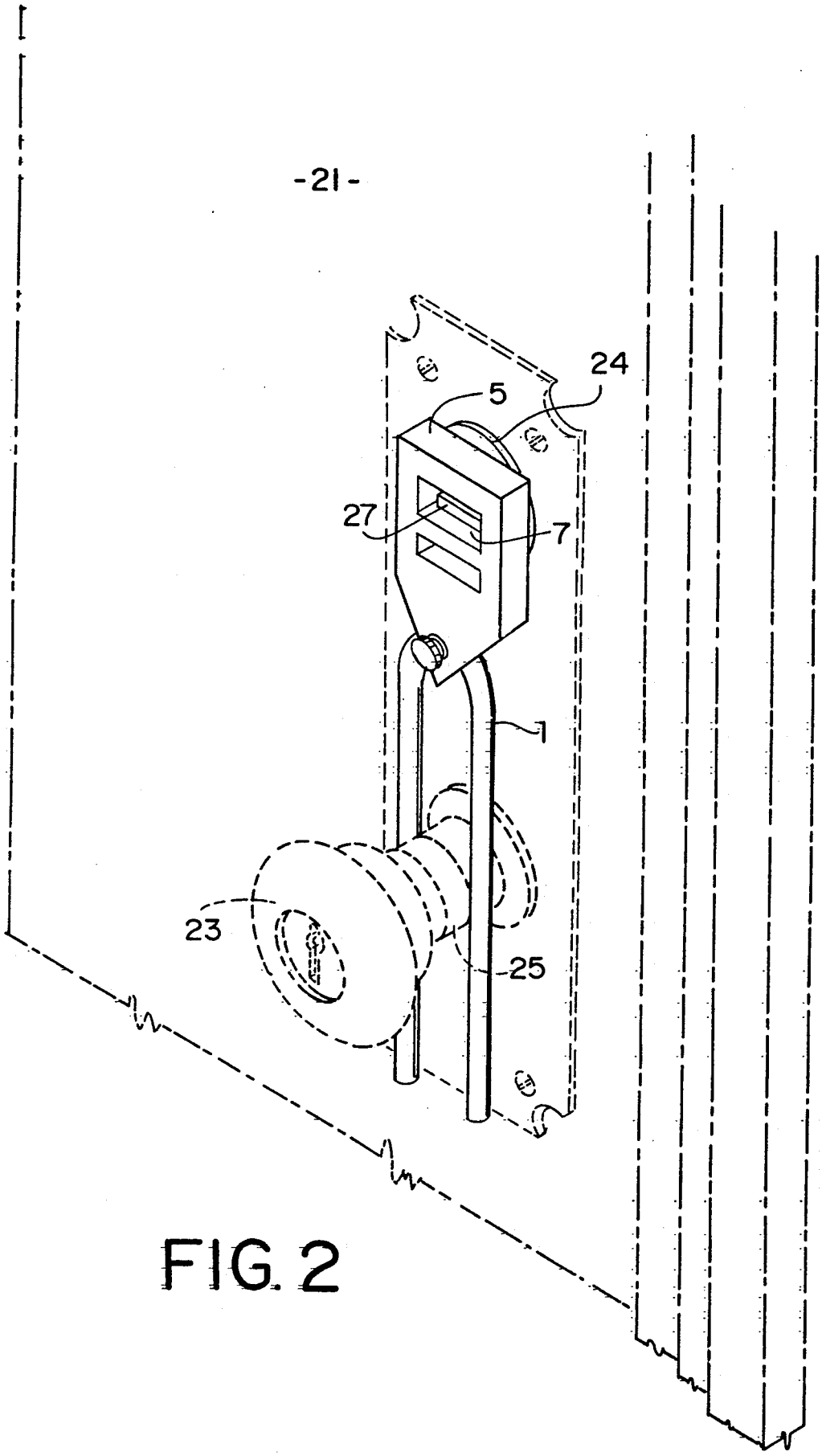
FIG. 2 shows the improved security device in an exemplary use.

With reference to FIG. 2, an exemplary use of the improved security device is illustrated. As can be seen from FIG. 2, the U-shaped member 1 is slid over the shaft 25 of the doorknob 23 on door 21. The rectangular opening 7 of the locking plate 5 is shown having inserted therein the latch 27 of the deadbolt 24. In this configuration, the locking plate 5 prevents rotation of the deadbolt latch 27 to prevent unlocking of the door. The locking plate 5, being pivotally attached to the U-shaped member 1, is secured in place by the U-shaped member 1 engaging the shaft 25 of the doorknob 23. The U-shaped configuration of the member 1 permits vertical adjustment of the improved security device so as to accommodate different spacings between the doorknob 23 and a deadbolt 24. Furthermore, should the deadbolt 24 be a double keyed cylinder type, the locking plate 5 may be vertically adjusted upward such that the slot 9 of the locking plate 5 may receive the key head of a key inserted into the deadbolt, thereby preventing rotation of the key and unlocking of the door.

The improved security device may be made of any material, with a preferred material including plastic so as not to damage a door or hardware associated therewith. Furthermore, any known means to pivotally connect the U shaped member with the locking plate may be utilized in substitution of the disclosed nut and bolt assembly.

The improved security device may be used in conjunction with doors having deadbolts therein in multi unit dwellings, shared accommodations, temporary homes, motels or the like. The improved security device provides advantages over other known prior art devices. For example, no professional installation is required in utilizing the improved security device. The improved security device may be adjusted to fit different spacings between doorknobs and associated deadbolts. Furthermore, the improved security device may remain on the shaft of the doorknob when not in use and requires little manual dexterity to operate. In addition, the improved security device may be utilized with misaligned doorknob and deadbolt combinations by merely adjusting the pivotal attachment between the locking plate and the U-shaped member.

As such, an invention has been disclosed in terms of a preferred embodiment thereof which fulfills each and every one of the objects of the invention as set forth hereinabove and provides a new and improved security device of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved security device mountable on an inside surface of a closure and comprising:

(a) a U-shaped member;

(b) a locking plate having upper, middle and lower regions, said locking plate having a first opening in said upper region being adapted to engage a latch of a deadbolt and a second opening in said middle region being adapted to engage a key head of a key inserted into a deadbolt; and (c) pivotal connecting means in said lower region for removably connecting said U-shaped member to said locking plate with said U-shaped member extending below said locking plate;

(d) whereby said U-shaped member may engage a shaft of an interior doorknob of said closure, and said locking plate, while attached to said U-shaped member, may engage a latch or a key head associated with a deadbolt while in a locked position to prevent rotation thereof and unlocking of a said deadbolt.

2. The invention of claim 1, wherein said locking plate includes a third opening, said U-shaped member includes a fourth opening in a curved portion thereof and said pivotal connecting means further comprises a nut and bolt assembly being adapted to engage each said third and fourth opening to removably connect said U-shaped member to said locking plate.

3. The invention of claim 1, wherein said improved security device is made of a pliable plastic.

4. The invention of claim 1, wherein said first opening is substantially rectangular and is generally horizontally elongated.

* * * * *